US007052300B2

(12) United States Patent
Okita et al.

(10) Patent No.: US 7,052,300 B2
(45) Date of Patent: May 30, 2006

(54) ELECTRICAL CONNECTOR WITH IMPROVED ACTUATOR

(75) Inventors: Masao Okita, Furukawa (JP); JiaBin Liu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/994,870

(22) Filed: Nov. 22, 2004

(65) Prior Publication Data

US 2005/0118849 A1 Jun. 2, 2005

(30) Foreign Application Priority Data

Nov. 28, 2003 (CN) ..... 2003 2 0120091

(51) Int. Cl.
*H01R 13/15* (2006.01)

(52) U.S. Cl. ..... 439/260

(58) Field of Classification Search ..... 439/260, 439/492, 494, 495, 499
See application file for complete search history.

(56) References Cited

U.S. PATENT DOCUMENTS

| | | | | |
|---|---|---|---|---|
| 5,842,883 | A | 12/1998 | Igarashi et al. | |
| 6,099,346 | A | 8/2000 | Hashiguchi et al. | |
| 6,338,648 | B1 * | 1/2002 | Miura et al. | 439/495 |
| 6,471,541 | B1 * | 10/2002 | Kunishi et al. | 439/495 |
| 6,517,367 | B1 * | 2/2003 | Yamane | 439/260 |
| 6,755,682 | B1 * | 6/2004 | Kunishi et al. | 439/495 |

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical connector (1) is provided for connecting a flexible printed circuit or a flexible flat cable. The connector comprises a housing (10), a number of electrical contacts (30) received in the housing and an actuator (40). The housing has a pair of concave portions (117) formed on opposite lateral ends thereof and opening upwardly to exterior. Each electrical contact comprises a support arm (35) defining a pivot portion (351) at an end thereof. The actuator has a pair of turning shafts (42) received in the corresponding concave portions and a plurality of turning pintles (411) therein for engaging with the pivot portions of the electrical contacts.

20 Claims, 7 Drawing Sheets

ELECTRICAL CONNECTOR WITH IMPROVED ACTUATOR

BACKGROUND OF THE INVENTION

1. Field of the Invention

The present invention is generally related to the art of electrical connectors, and more particularly, to an electrical connector used for connecting a flexible printed circuit or a flexible flat cable.

2. Description of Related Art

A variety of flexible printed circuits are widely used in electronic devices, such as notebooks, mobile phones and fax machines. Various electrical connectors are adapted for connecting corresponding flexible printed circuits. There is a conventional flexible printed circuit connector disclosed in U.S. Pat. No. 5,842,883. The connector includes an insulated housing, a plurality of first electrical contacts and second electrical contacts and an actuator. Each first electrical contact comprises a first arm portion having a pivot portion at an end thereof. The actuator includes a concave portion engaging with the pivot portions of the first electrical contacts. The first electrical contacts are secured in the housing in predetermined pitches, and the actuator is mounted to the housing via the engagement of the concave portion and pivot portions of the first electrical contacts. When the actuator is set in a first position, a flexible printed circuit is inserted into the housing, with zero insertion force or low insertion force, and then the actuator is rotated from the first position to a second position for pressing the flexible printed circuit against the first and the second electrical contacts. However, in the rotational process above mentioned, the actuator is easily broken off the housing, that is, the concave portion are rotated away from the pivot portions of the first electrical contacts. With this arrangement, the connection between the connector and the flexible printed circuit is so unreliable that it hardly reaches the standard which some electronic devices such as notebooks, mobile phones and fax machines require.

U.S. Pat. No. 6,099,346 discloses another type of flexible printed circuit connector. The connector includes an insulated housing, a plurality of electrical contacts received in the housing and an actuator mounted to the housing. Each electrical contact comprises a support arm defining a pivot portion at an end thereof. The actuator comprises a plurality of cam portions received in the pivot portions of the electrical contacts. When a flexible printed circuit is inserted into the housing, the actuator is rotated from a first position to a second position and presses a connecting end of the flexible printed circuit against the electrical contacts via the rotation of the cam portions in the pivot portions of the electrical contacts, the electrical connection between the flexible printed circuit and the connector is established. However, for the structure of the cam portion, the actuator is rotated from the first position to the second position around a changeable axis of rotation, so it is possible that the actuator is moved slidingly in the rotation. This arrangement of the actuator induces that the flexible printed circuit is not secured in a predetermined position, and the electrical contacts connects with the connecting end of the flexible printed circuit unreliably.

Hence, a flexible printed circuit connector with an improved actuator is highly desired to overcome the aforementioned disadvantages of the prior art.

SUMMARY OF THE INVENTION

Accordingly, an object of the present invention is to provide an electrical connector, which provides stable and reliable electrical connection between the connector and a flexible printed circuit.

In order to achieve the object set forth, an electrical connector is provided. The electrical connector comprises an insulated housing, a plurality of electrical contacts received in the housing and an actuator mounted to the housing. The housing has a pair of concave portions formed on opposite lateral ends thereof and opening upwardly to exterior. Each electrical contact comprises a support arm defining a pivot portion at an end thereof. The pivot portions open downwardly to the bottom of the housing. The actuator has a pair of turning shafts received in the corresponding concave portions and a plurality of turning pintles therein for engaging with the pivot portions of the electrical contacts. When a flexible printed circuit is inserted into the connector, the actuator is rotated from a position to another position, and the turning shafts and the turning pintles respectively pivot about the concave portions and the pivot portions.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
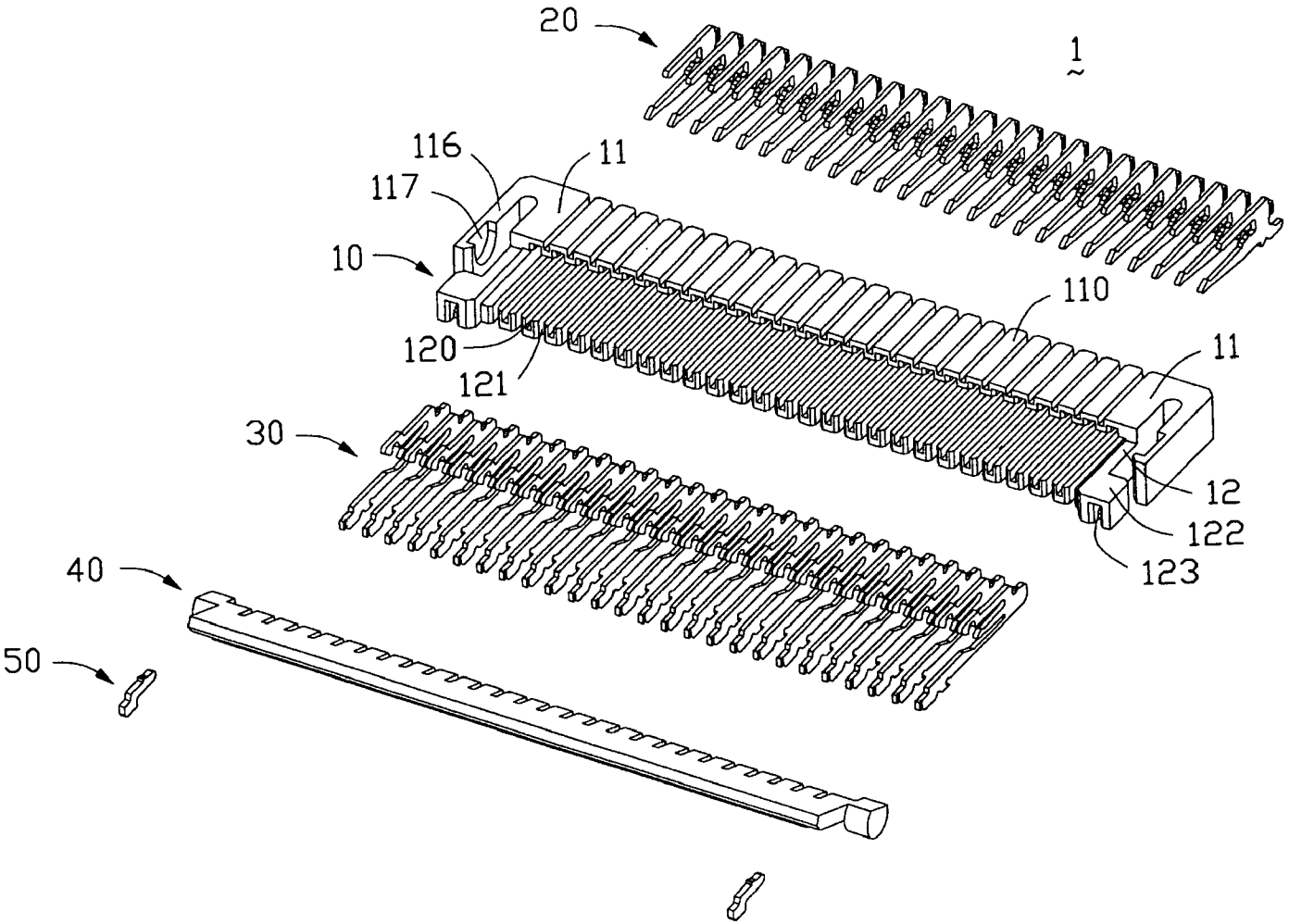
FIG. 1 is a front, exploded, perspective view of an electrical connector in accordance with the present invention.
Figure 2:
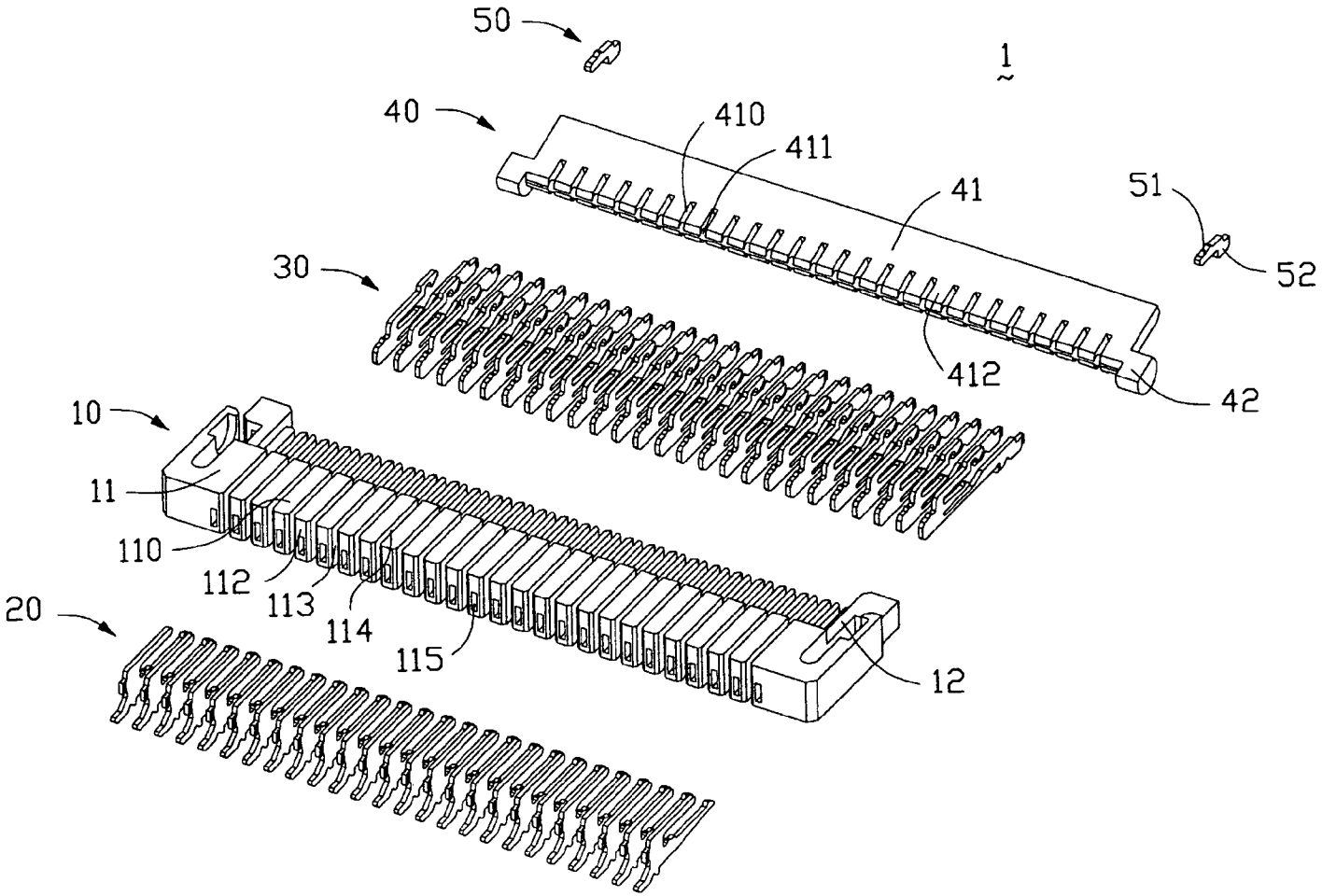
FIG. 2 is a rear, exploded, perspective view of the electrical connector in accordance with the present invention.
Figure 5:
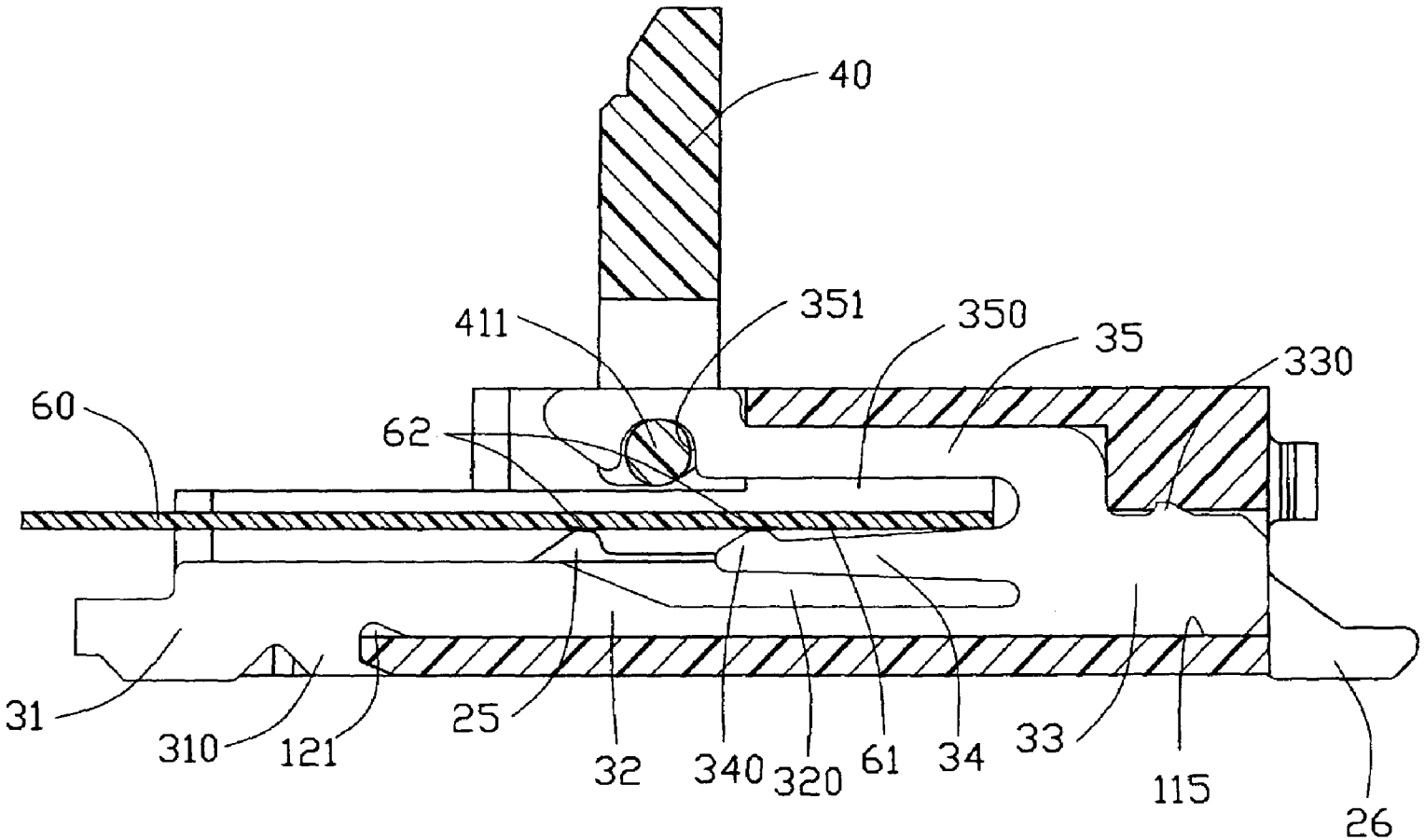
FIG. 5 is a cross-sectional view of the electrical connector taken along line 5—5 of FIG. 3, with a flexible printed circuit inserted therein and the actuator set in the opening position.

Referring to FIG. 1 and FIG. 2, an electrical connector 1 in accordance with the present invention is provided for electrically connecting a flexible printed circuit (FPC) 60 (shown in FIG. 5). The connector 1 comprises an insulated housing 10, a plurality of front electrical contacts 20 and rear electrical contacts 30, an actuator 40 mounted to the housing 10 and a pair of positioning members 50.

Figure 4:
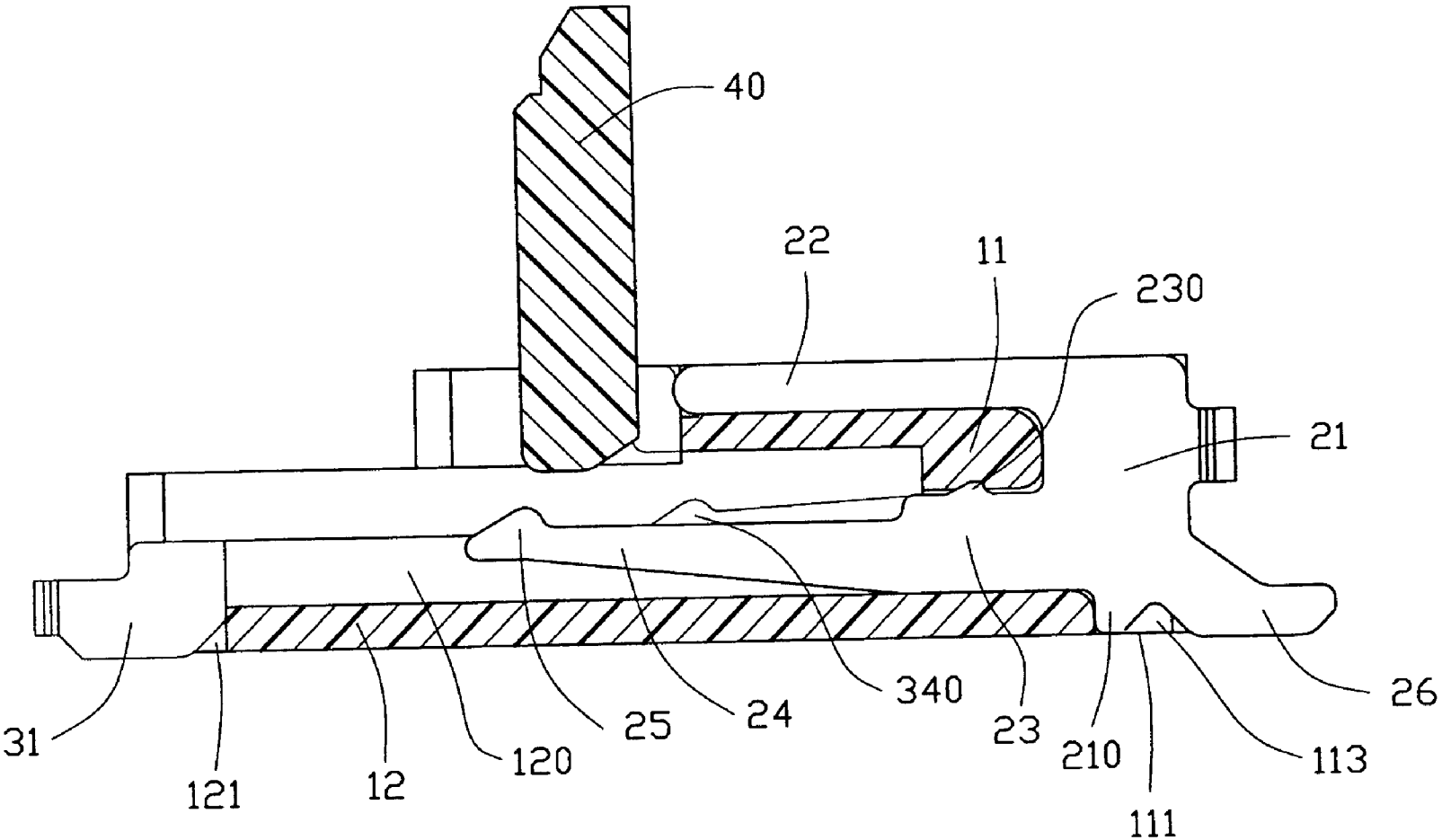
FIG. 4 is a cross-sectional view of the electrical connector, taken along line 4—4 of FIG. 3, wherein an actuator of the electrical connector is set in an opening position.

Referring to FIG. 1 and FIG. 2 and in conjunction with FIG. 4 and FIG. 5, the insulated housing 10 is approximately rectangular and comprises a base portion 11 and a mating portion 12 extending forwardly from the base portion 11. The base portion 11 includes a top surface 110, a bottom surface 111 opposite to the top surface 110 and a rear surface 112. A plurality of receiving channels 113 are arranged at regular intervals along longitudinal direction in the base portion 11. A plurality of slots 114 are formed on the top surface 110 and are in communication with the corresponding channels 113. The mating portion 12 defines a plurality of grooves 120 and a plurality of passageways 121 thereon. The grooves 120 and the passageways 121 are arranged alternately along the longitudinal direction. The grooves 120 extend rearwardly though the base portion 11 and are in communication with the receiving channels 113. The passageways 121 extend rearwardly through the rear surface 112 of the base portion 11, and a plurality of fixing holes 115 are formed therein. Seen from the rear surface 112 of the base portion 11, the fixing holes 115 and the receiving channels 113 are located alternately along the longitudinal direction. A pair of beams 116 extend outwardly and forwardly from opposite lateral ends of the base portion 11 and apart from the mating portion 12 a distance. Each beam 116 defines a camber concave portion 117 extending through an upper and an inner surface of the beam 116. The mating portion 12 comprises a pair of positioning portions 122 formed on opposite lateral ends thereof. Each positioning portion 122 defines a positioning slot 123 for receiving the corresponding positioning member 50.

The front electrical contacts 30 are referred as first electrical contacts and are secured in the corresponding passageways 121 of the housing 10. Each front contact 30 comprises a solder portion 31 extending out of the front end of the mating portion 12, a connect portion 32 extending rearwardly from the solder portion 31, a fixing portion 33 connected with the connect portion 32 and secured in the fixing hole 115 of base portion 11, a resilient arm 34 extending forwardly from the fixing portion 33 and a support arm 35 extending forwardly from the fixing portion 33 and parallel to the resilient arm 34. The solder portion 31 has a barrier 310 which abuts against the bottom wall of the housing 10 for preventing the front contacts 30 from moving rearwardly. The resilient arm 34 has a contact portion 340 projecting upwardly at a cantilever end thereof. A receiving space 350 is provided between the support arm 35 and the resilient arm 34 for receiving the flexible printed circuit 60. A gap 320 is formed between the resilient arm 34 and the connect portion 32. When the flexible printed circuit 60 is inserted into the receiving space 350, the resilient arm 34 is pressed into the gap 320. The support arm 35 has a pivot portion 351 which is arched in shape and opens to the receiving space 350.

The rear electrical contacts 20 are referred as second electrical contacts and are secured in the base portion 11 from the rear portion of the housing 10. Each of rear electrical contacts 20 comprises a main portion 21 secured in the corresponding receiving channel 113, a balance beam 22 extending forwardly from the main portion 21 and received in the corresponding slot 114 of the top surface 110 of the base portion 11, a retention portion 23 extending forwardly from the bottom portion of the main portion 21, a resilient beam 24 extending forwardly from the retention portion 23 and a tail portion 26 connecting with the main portion 21 and opposite to the resilient beam 24. The resilient beam 24 has a contact portion 25 projecting upwardly from the upper surface of the resilient beam 24. A stopper 210 projects from the bottom surface of the main portion 21 to prevent the rear contacts 20 from moving forwardly. The retention portion 23 has barbs 230 on the upper surface thereof for fixing the rear contacts 20 in the housing 10.

Figure 3:
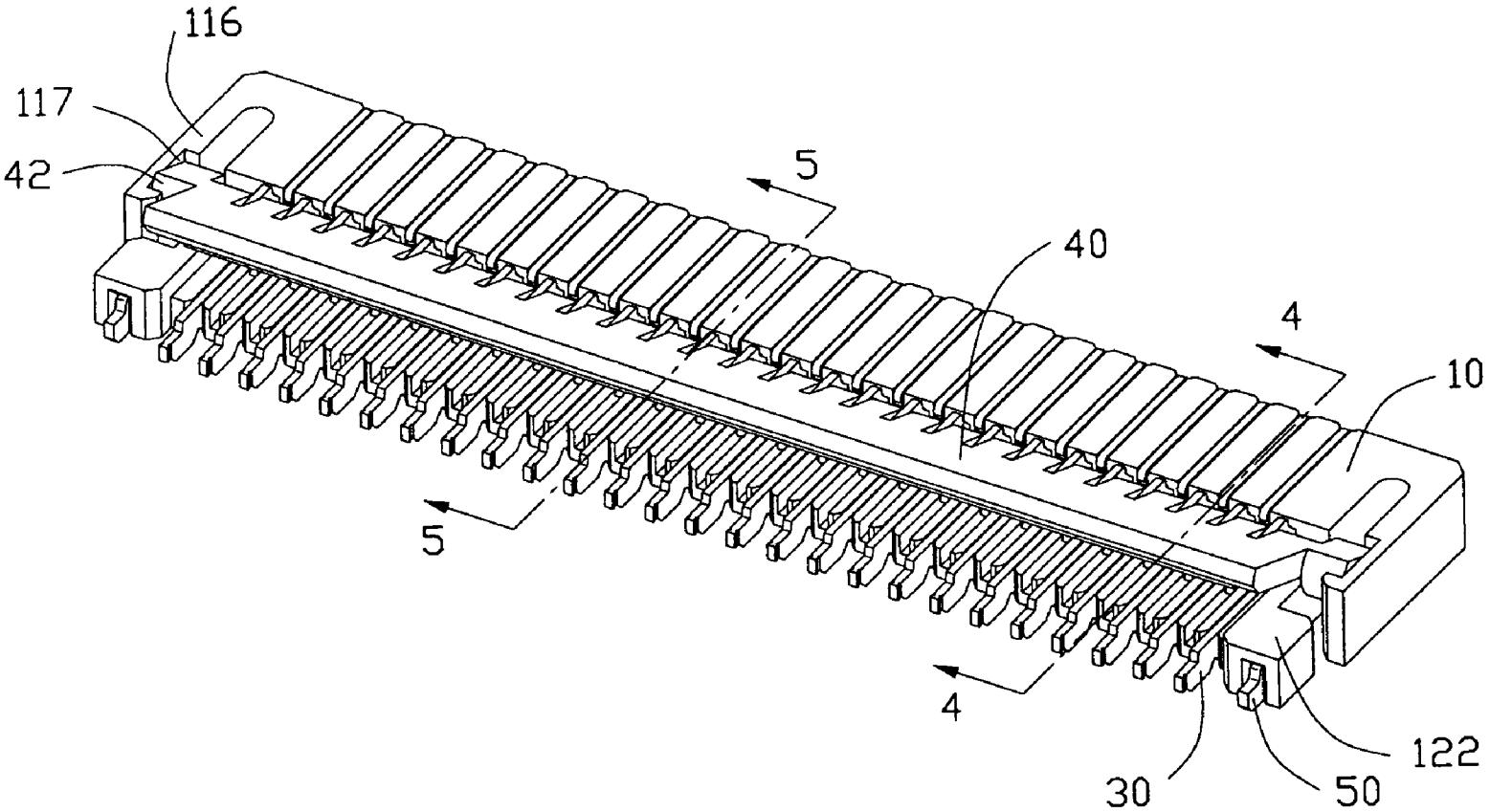
FIG. 3 is a front, assembled, perspective view of the electrical connector in accordance with the present invention.
Figure 7:
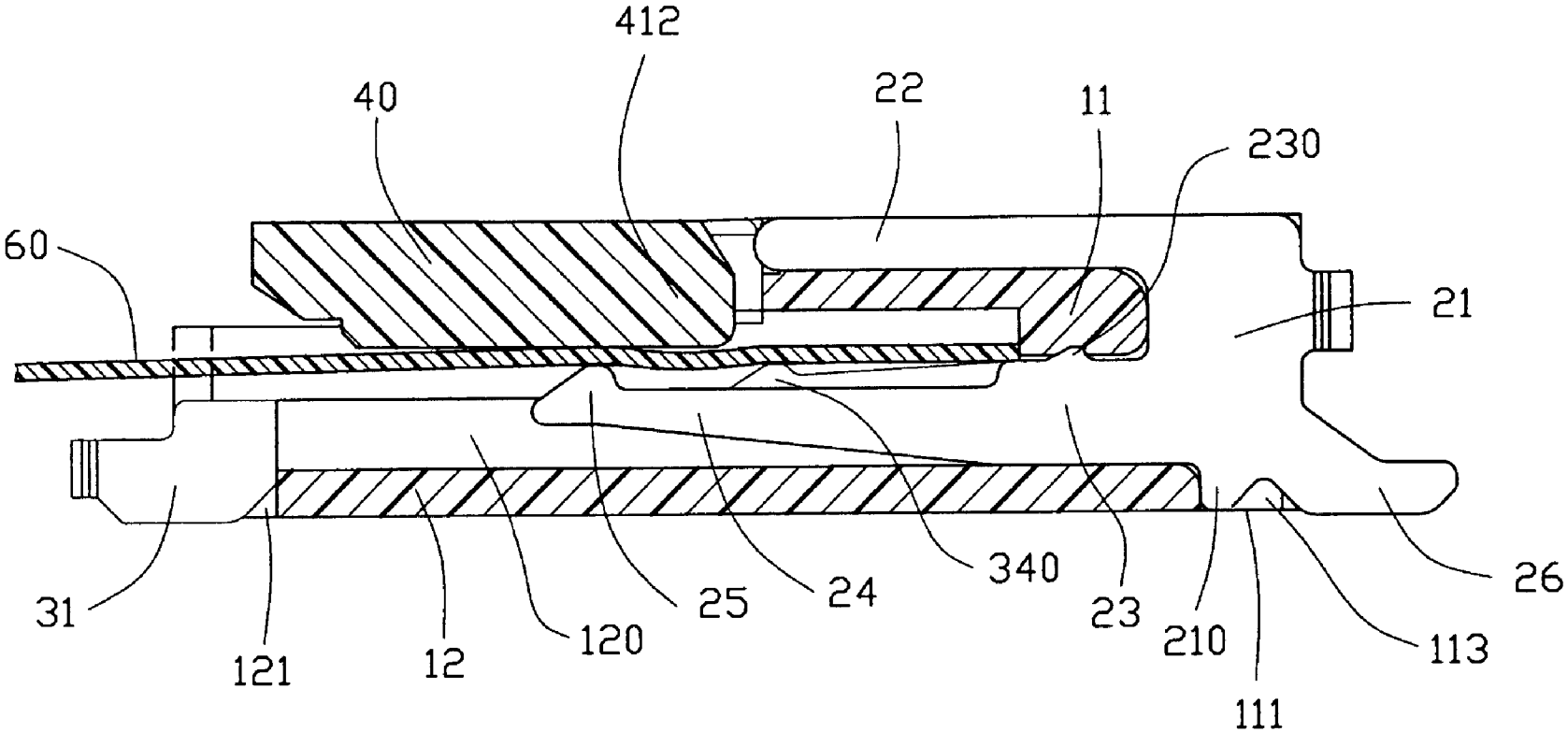
FIG. 7 is a cross-sectional view of the electrical connector taken along line 4—4 of FIG. 3, with the flexible printed circuit inserted therein and the actuator of the electrical connector set in the closed position.

Referring to FIG. 1 and FIG. 2 and in conjunction with FIGS. 3, 5 and 7, the actuator 40 comprises a plate 41 and a pair of turning shafts 42 formed on opposite lateral ends of the plate 41. The plate 41 defines a plurality of cutouts 410 extending along up-down direction though the plate 41 and a plurality of cam portions 412. The cutouts 410 and the cam portions 412 are located alternatively at a front portion of the plate 41. Each cutout 410 has a turning pintle 411 therein. When the actuator 40 is top-down located into the housing 10, the two turning shafts 42 are received in the corresponding the concave portions 117, each turning pintle 411 respectively engages with the pivot portion 351 of the front electrical contact 30 and the cam portions 412 press the flexible printed circuit 60 to electrical contact with the electrical contacts 20, 30. As the pivot portion 351 opens downwardly toward receiving space 350, and the camber concave portion 117 opens upwardly to exterior, thus, when the actuator is rotated from a first position to a second position, it is hardly occurred that the actuator 40 breaks off the housing 10. Accordingly, the arrangement of the connector 1 ensures that the stable and reliable electrical connection is provided between the connector 1 and the flexible printed circuit 60.

Each positioning member 50 comprises a retention portion 51 fixing in the positioning slot 123 of the housing 10 and a solder portion 52. When the electrical connector 1 is mounted to a printed circuit board (not shown), the solder portions 31 of the front contacts 30 and the tail portions 26 of the rear contacts 20 are soldered on the printed circuit board. Furthermore, the solder portions 52 of the pair of positioning members 50 are also soldered on the printed circuit board so that the positioning members 50 improve the performance of the connection between the connector 1 and printed circuit board.

Figure 6:
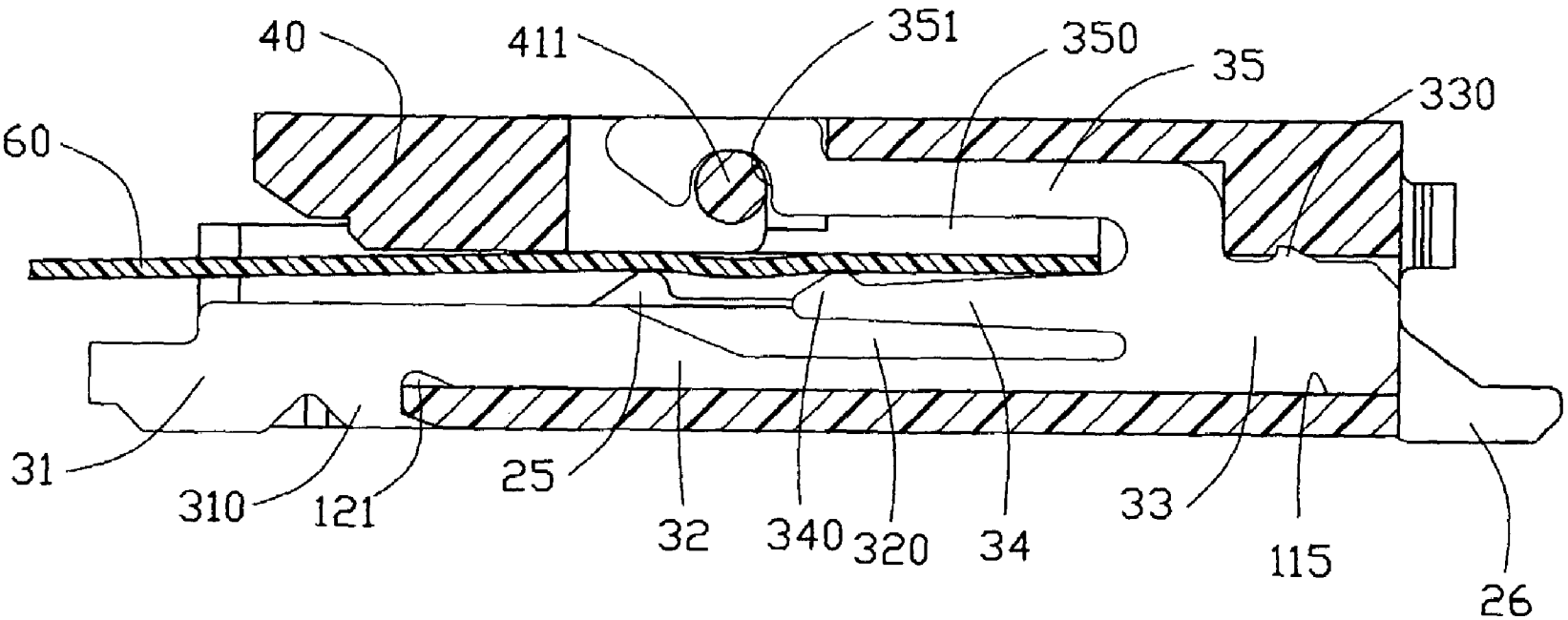
FIG. 6 is a similar view of FIG. 5, but the actuator is set in a closed position.

Referring to FIG. 5 through FIG. 7, when the actuator 40 is set in a opening position defined as a first position, a connecting end 61 of the flexible printed circuit 60 is inserted into the receiving space 350 of the housing 10, with zero insertion force or low insertion force. When the actuator 40 is rotated from the opening position to a closed position defined as a second position, the plate 41 presses the connecting end 61 of the flexible printed circuit 60 against the front contacts 30 and the rear contacts 20, thus the contact portions 340, 25 of the front contacts 30 and the rear contacts 20 electrically contact with corresponding conductive portions 62 of the connecting end 61.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a flexible printed circuit, comprising:

a housing comprising a pair of concave portions defined in opposite lateral ends thereof and opening upwardly to exterior and a plurality of passageways;

a plurality of first electrical contacts received in the corresponding passageways, each first electrical contact comprising a solder portion extending out the housing, a fixing portion retaining the electrical contact in the housing, a connect portion connecting the solder portion with the fixing portion, a support arm defining a pivot portion which opens downwardly and a resilient arm extending forward from the fixing portion; and an actuator comprising a pair of turning shafts pivotally received in corresponding concave portions, a plurality of cam portion for pressing the flexible printed circuit to contact with the first electrical contacts and a plurality of turning pintles pivotally received in the pivot portions of the first electrical contacts.

2. The electrical connector as claimed in claim 1, wherein the housing defines a plurality of fixing holes in communication with the corresponding passageways for retaining the fixing portions of the first electrical contacts therein.

3. The electrical connector as claimed in claim 2, wherein the fixing portion of the first electrical contact has barbs abutting against the inner surface of the fixing hole.

4. The electrical connector as claimed in claim 1, wherein a receiving space is provided between the support arm and the resilient arm for receiving a flexible printed circuit, and the resilient arm has a contact portion projecting toward the support arm.

5. The electrical connector as claimed in claim 1, wherein the solder portion of the first electrical contact has a barrier for preventing the first electrical contact from moving rearwardly.

6. The electrical connector as claimed in claim 1, further comprising a plurality of second electrical contacts.

7. The electrical connector as claimed in claim 6, wherein the first electrical contacts and the second electrical contacts are located alternately in the housing.

8. The electrical connector as claimed in claim 6, wherein the housing defines a plurality of receiving channels, a plurality of slots in communication with corresponding receiving channels and a plurality of grooves which extends through the housing to be in communication with the receiving channels.

9. The electrical connector as claimed in claim 8, wherein each second electrical contact comprises a main portion located in corresponding receiving channel, a balance beam extending forwardly from a top portion of the main portion and received in the slot of the housing, a retention portion extending forwardly from the main portion, a resilient beam extending from the retention portion and parallel to the balance beam, and a tail portion extending oppositely to the retention portion.

10. The electrical connector as claimed in claim 9, wherein the resilient beam has a contact portion projecting toward the balance beam.

11. The electrical connector as claimed in claim 9, wherein the main portion has a stopper abutting against the bottom wall of the housing for preventing the second electrical contact from moving forwardly.

12. The electrical connector as claimed in claim 1, further comprising a pair of positioning members, and wherein the housing has a pair of positioning slots formed on lateral ends thereof for receiving the positioning members.

13. The electrical connector as claimed in claim 12, wherein each positioning member comprises a retention portion and a solder portion for connecting the electrical connector to a printed circuit board.

14. The electrical connector as claimed in claim 1, wherein the actuator comprises a plate defining a plurality of cutouts therein along a longwise direction, and the turning pintles are respectively formed in corresponding cutouts.

15. The electrical connector as claimed in claim 14, wherein the cutouts and the cam portions are located alternatively at a front portion of the plate in the longwise direction.

16. An electrical connector for a flexible printed circuit (FPC), comprising:

An insulative housing defining opposite front and rear faces and a receiving space extending inwardly from the front face;

a plurality of first passageways and a plurality of second passageways alternately arranged in the housing along a lengthwise direction thereof;

a plurality of first contacts rearwardly inserted into the corresponding first passageways, respectively, from the front face;

a plurality of second contacts forwardly inserted into the corresponding second passageways, respectively, from the rear face; and an actuator pivotally mounted to the housing with a plurality of turning pintles rotatably engaged within corresponding arc-like pivotal portions of the first contacts; wherein each second contact includes a balanced beam flush with a top face of the housing.

17. The connector as claimed in claim 16, wherein said pivotal portion is formed on a front end of a support arm of the first contacts, and upper edge of said front end is essentially flush with the top face of the housing.

18. The connector as claimed in claim 17, wherein the first contact includes a first resilient contact arm opposite to said support arm for engagement with the FPC, and the second contact includes a second resilient contact arm opposite to said balanced arm for engagement with the FPC.

19. An electrical connector for a flexible printed circuit (FPC), comprising:

an insulative housing defining opposite front and rear faces and a receiving space extending inwardly from the front face;

a plurality of first passageways and a plurality of second passageways alternately arranged in the housing along a lengthwise direction thereof;

a plurality of first contacts rearwardly inserted into the corresponding first passageways, respectively, from the front face, each of the first contacts defining a first lower resilient contact arm and a first upper stiff holding arm; and a plurality of second contacts forwardly inserted into the corresponding second passageway, respectively, from the rear face, each of said second lower resilient contact defining a second lower resilient contact arm and a second upper stiff holding arm; wherein both said first lower resilient contact arm and said second lower resilient contact arm are located in a same level for common engagement with the FPC while the first upper stiff holding arm is located at a level lower than that of the second upper stiff holding arm.

20. The connector as claimed in claim 19, wherein the second upper stiff holding arm is essentially fully upwardly exposed to an exterior while the first upper stiff holding arm is essentially mostly upwardly covered by a top face of the housing except a front end thereof.

* * * * *